US007950566B2

(12) United States Patent
Boden et al.

(10) Patent No.: US 7,950,566 B2
(45) **Date of Patent: *May 31, 2011**

(54) METHOD OF WELDING HEATED LOG SEGMENTS IN AN ALUMINUM EXTRUSION PROCESS

(75) Inventors: Derek William Boden, Brighton (AU); Scott David Buiten, Ada, MI (US)

(73) Assignees: G. James Australia Pty. Ltd., Brisbane (AU); Granco Clark, Inc., Belding, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/750,000

(22) Filed: Mar. 30, 2010

(65) Prior Publication Data

US 2010/0181369 A1 Jul. 22, 2010

Related U.S. Application Data

(62) Division of application No. 11/969,471, filed on Jan. 4, 2008, now Pat. No. 7,712,651.

(51) Int. Cl.
*B23K 20/12* (2006.01)
*B23K 31/02* (2006.01)

(52) U.S. Cl. ..... 228/112.1; 228/160; 228/170

(58) Field of Classification Search ..... None
See application file for complete search history.

(56) References Cited

U.S. PATENT DOCUMENTS

| | | | | |
|---|---|---|---|---|
| 2,187,740 A | | 1/1940 | Hothersall | |
| 2,912,563 A | | 11/1959 | Schlieker et al. | |
| 3,062,249 A | * | 11/1962 | Gray | 83/155 |
| 3,198,931 A | * | 8/1965 | Klempay | 228/5.7 |
| 3,369,385 A | | 2/1968 | Murphy et al. | |
| 3,394,213 A | * | 7/1968 | Roberts et al. | 264/102 |
| 3,394,857 A | * | 7/1968 | Wheeler et al. | 228/5.7 |
| 3,769,124 A | * | 10/1973 | Johnson | 156/159 |
| 3,816,696 A | * | 6/1974 | Wheeler et al. | 219/124.21 |
| 3,984,652 A | * | 10/1976 | Graville | 219/73 |
| 4,651,602 A | | 3/1987 | Harrold et al. | |
| 4,679,475 A | * | 7/1987 | Antezana | 83/420 |
| 4,787,281 A | * | 11/1988 | Gardner | 83/15 |

(Continued)

FOREIGN PATENT DOCUMENTS

DE 3120464 9/1982

(Continued)

OTHER PUBLICATIONS

Notification of Transmittal of the International Search Report and the Written Opinion of the International Searching Authority, or the Declaration, International Search Report, Written Opinion of the International Searching Authority, mailed Jan. 22, 2009.

*Primary Examiner* — Kiley Stoner

(74) *Attorney, Agent, or Firm* — Warner Norcross & Judd LLP

(57) ABSTRACT

A method of processing heated metal logs in a metal extrusion process. The remainder of each log is attached to the succeeding log. Specifically, the abutted ends of the two log segments are aligned with a saw. The saw is actuated to simultaneously remove material from both of the abutted ends. The cut ends are friction welded together through relative rotation of the log segments. The process creates a heated log column that is effectively endless, eliminating log remainders.

6 Claims, 10 Drawing Sheets

U.S. PATENT DOCUMENTS

| | | | | |
|---|---|---|---|---|
| 4,840,303 | A * | 6/1989 | Fujii et al. | 228/164 |
| 4,901,611 | A * | 2/1990 | Bentley | 82/100 |
| 5,062,299 | A | 11/1991 | Davis et al. | |
| 5,532,451 | A | 7/1996 | La Rocca | |
| 5,709,585 | A | 1/1998 | Matsuo et al. | |
| 5,836,190 | A | 11/1998 | Wompner et al. | |
| 6,893,531 | B1 * | 5/2005 | Todaro et al. | 156/304.3 |
| 2002/0011469 | A1 * | 1/2002 | Miyata et al. | 219/82 |
| 2004/0231391 | A1 | 11/2004 | Wompner et al. | |
| 2005/0034502 | A1 | 2/2005 | Kohn | |

FOREIGN PATENT DOCUMENTS

| | | | |
|---|---|---|---|
| DE | 10232608 | | 1/2003 |
| DE | 202004008241 | | 12/2004 |
| DE | 102006007850 | | 8/2007 |
| EP | 0065933 | A2 | 12/1982 |
| EP | 0244063 | | 11/1987 |
| EP | 0467875 | | 1/1992 |
| EP | 0787543 | A2 | 1/1997 |
| EP | 0791409 | | 8/1997 |
| GB | 1463020 | | 2/1977 |
| JP | 5581017 | | 6/1980 |
| JP | 57154313 | | 9/1982 |
| JP | 58034715 | A * | 3/1983 |
| JP | 03193207 | | 3/1991 |
| JP | 06007968 | | 1/1994 |
| JP | 2002224707 | | 8/2002 |
| JP | 2002224856 | | 8/2002 |
| JP | 2004-34254 | A * | 2/2004 |
| WO | 0178935 | | 10/2001 |

* cited by examiner

NL
LR
NEXT LOG
LOG REMAINDER

NEXT LOG
LOG REMAINDER

NEXT LOG
LOG REMAINDER

LOG REMAINDER
NEXT LOG
Push back to center

Clamp
NEXT LOG
LOG REMAINDER

LOG COLUMN
AP
NEXT LOG
LOG REMAINDER
RM

BILLET
LC
LOG REMAINDER
B

Saw Blade CL

METHOD OF WELDING HEATED LOG SEGMENTS IN AN ALUMINUM EXTRUSION PROCESS

BACKGROUND OF THE INVENTION

The present invention relates to aluminum extrusion, and more particularly to the process of cutting billets from aluminum logs exiting a furnace.

Aluminum extrusion is a well known and widely practiced technology. Aluminum logs are heated within a log furnace to a temperature suitable for extrusion. As each log exit the furnace, billets are cut from the log and transferred to an extrusion press. With the press, the billet is extruded through a die to create an article having a desired shape and length. The total length of the extruded shape is a multiple of the length of the pieces to be cut from the shape plus process scrap. The required billet length is directly proportional to the desired extrusion length.

Cutting billets of desired lengths from a heated aluminum log creates remainders or off-cuts. One challenge in aluminum extrusion is to use the remainders or off-cuts without resorting to recycling or re-melting due to the inherent costs involved. The preferred method for the use of remainders or off-cuts is to combine them with another log segment (known as a "short-cut piece") to create a two-piece billet. The two-piece billet is loaded into the press container, and the two pieces fuse together as the abutting faces of the two pieces pass through the extrusion die. Unfortunately, the spaces and gaps between the two pieces entrap air that produces unacceptable blisters in the finished product. Furthermore, the oxide film on the two abutting faces of the two-piece billet produces defective or unsound fusions or welds between the faces as the aluminum moves through the extrusion die.

One prior art attempt has been made to create an effectively "continuous" log as input to the furnace. Specifically, sequential logs are attached together in end-to-end fashion as the logs are moved into the furnace. The attachment is created by "friction stir welding" or surface welding the abutting logs. This technique has at least two problems. First, the ends of the logs are rarely square; and the logs are rarely straight. Consequently, the connected logs result in a log column that is non-linear (i.e. snake-like). The log column does not lay evenly on the supporting rollers; and the log column is difficult to move through the furnace. Second, this technique does not resolve the above noted problems of entrapped air and oxide.

SUMMARY OF THE INVENTION

The aforementioned problems are overcome in the present invention comprising a method for attaching the remainder of each log to the succeeding log, thereby effectively creating a "continuous" log column at the exit end of the furnace. Consequently, billets of desired lengths can be continuously cut from the log column; and remainders are effectively eliminated.

In the current embodiment of the invention, the process includes cutting billets from a log exiting the furnace until a remainder piece is left, attaching the remainder piece to the next succeeding log exiting the furnace to create a log column, and then continuing to cut billets from the log column.

Preferably, the remainder is attached to the succeeding log through "twist welding" in which both axial pressure and relative rotational movement are applied to the two pieces. Twist welding melds and fuses the abutting faces. Yet further preferably, the cutting is done by sawing, which creates relatively square clean faces, which further enhances the attachment.

In one embodiment, the abutting faces of the remainder and the succeeding log are cut simultaneously before welding. This is accomplished by aligning the abutting faces with a saw blade, and then moving the saw blade through the abutting faces so that the saw kerf extends into both pieces.

In another embodiment, a billet is cut from the succeeding log before the remainder is attached to the succeeding log, The cut face of the remainder then is attached to the cut face of the succeeding log.

The present invention creates an effectively continuous log column downstream of the furnace from which billets can be continuously cut. All remainders are eliminated. When the faces both are cut before welding, the attachment of each remainder to a succeeding log vastly reduces the possibility that air or oxide will be entrained or trapped between each remainder and the succeeding log.

These and other objects, advantages, and features of the invention will be more fully understood and appreciated by reference to the description of the current embodiments and the drawings.

DESCRIPTION OF THE CURRENT EMBODIMENTS

I. System

Figure 1:
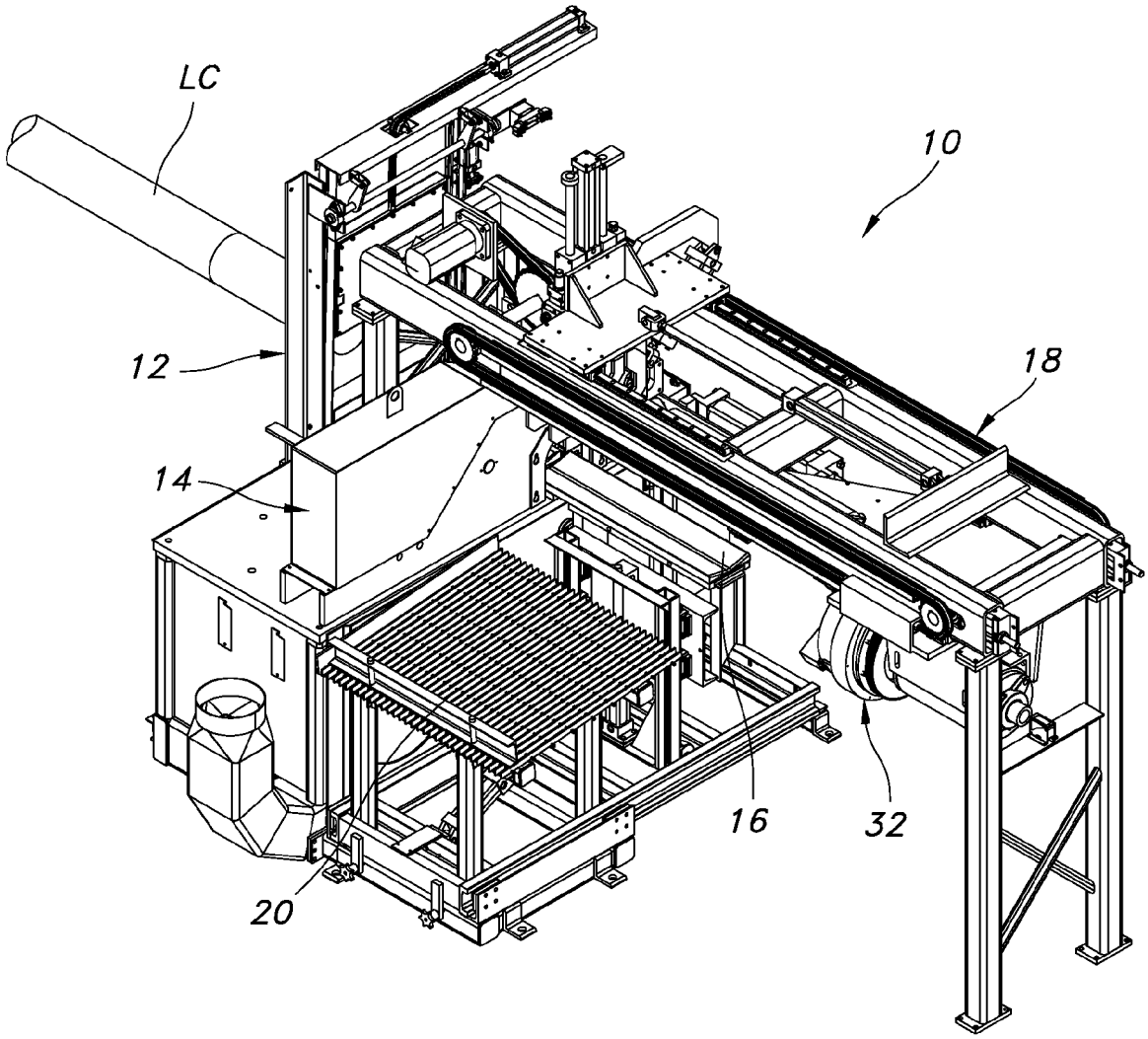
FIG. 1 is a perspective view of the hot log processing system of the present invention.

A system for processing or handling hot aluminum billets between a furnace and a press in an aluminum extrusion environment, and constructed in accordance with the current embodiment of the invention, is illustrated in FIGS. 1-6 and generally designated 10. The system receives a heated log column LC from a furnace (not shown). The system 10 cuts billets from the log column LC and delivers the billets to an extrusion press (not shown). The system performs the method of the present invention to create an effectively "endless" log column LC from which billets are cut for delivery to the press.

More specifically, the system 10 is located downstream of a furnace and upstream of an extrusion press. The furnace (not shown) may be any appropriate furnace for heating aluminum logs to be extruded. Such furnaces are well known in the art. One such furnace is the direct flame impingement furnace sold by Granco Clark, Inc. of Belding, Mich. under the designation "hot jet log furnace." Any other suitable furnace could be used.

The extrusion press (not shown) also can be any press generally known to those skilled in the art. One such press is any press sold by UBE Machinery Corporation, Ltd. of Japan. Such a press includes a container, a ram, and a die. The container receives a heated billet. The ram moves through the container to force the billet through an extrusion die.

The system 10 includes a furnace door assembly 12, a hot log saw 14, a discharge tray 16, and a handling assembly 18 for handling billets and remainders. The furnace door assembly 12, the hot log saw 14, and the discharge tray 16 are generally well known to those skilled in the art. The function of the door assembly 12 is to retain heat within the furnace except when the log column LC is moved out of the furnace for cutting. The function of the hot log saw 14 is to cut the log column LC to create billets. The saw includes a selectively activated hold-down to maintain the log in a stationary position during sawing. The function of the discharge tray 16 is to receive a cut billet and to deliver the cut billet to a transveyor (not shown) for subsequent delivery to the press. The function of the reject table 20 is to receive unusable billets from the discharge tray 16. All of these components have been sold by Granco Clark before the present invention, for example, in systems and equipment sold under the designation "hot billet cut-off saw" (HBCS).

The handling assembly 18 is new with the present invention. The assembly 18 includes a pair of grippers 30*a* and 30*b* and a chuck 32.

The grippers 30 can be closed or opened using conventional hydraulics or pneumatics to grasp or release a billet or remainder cut from the log column LC. The grippers 30 also can be reciprocated toward and away from the furnace door 12 (i.e. left or right as viewed in FIGS. 3-5). The grippers 30*a* and 30*b* also can be raised and lowered to move a billet or remainder to a temporary holding or storage position wherein the held piece does not interfere with subsequent movement of the log column LC.

The chuck 32, or any other suitable gripping device, can be closed or opened using conventional hydraulics or pneumatics. The chuck 32 can be reciprocated toward and away from the furnace door 12 (i.e. again left and right as viewed in FIGS. 3-5), and applies the required axial force between the pieces to be welded as will be described. Furthermore, the chuck can be rotated to create the relative rotation between the pieces to create the friction weld as will be described. The hydraulics or pneumatics required to effectuate the described movement and actuation of the grippers 30 and the chuck 32 are well within the capabilities of one skilled in the art and could be readily implemented based on the present specification. Alternatively, motive power could be provided by electrical motors or any other suitable technology.

II. First Method

Figure 7:
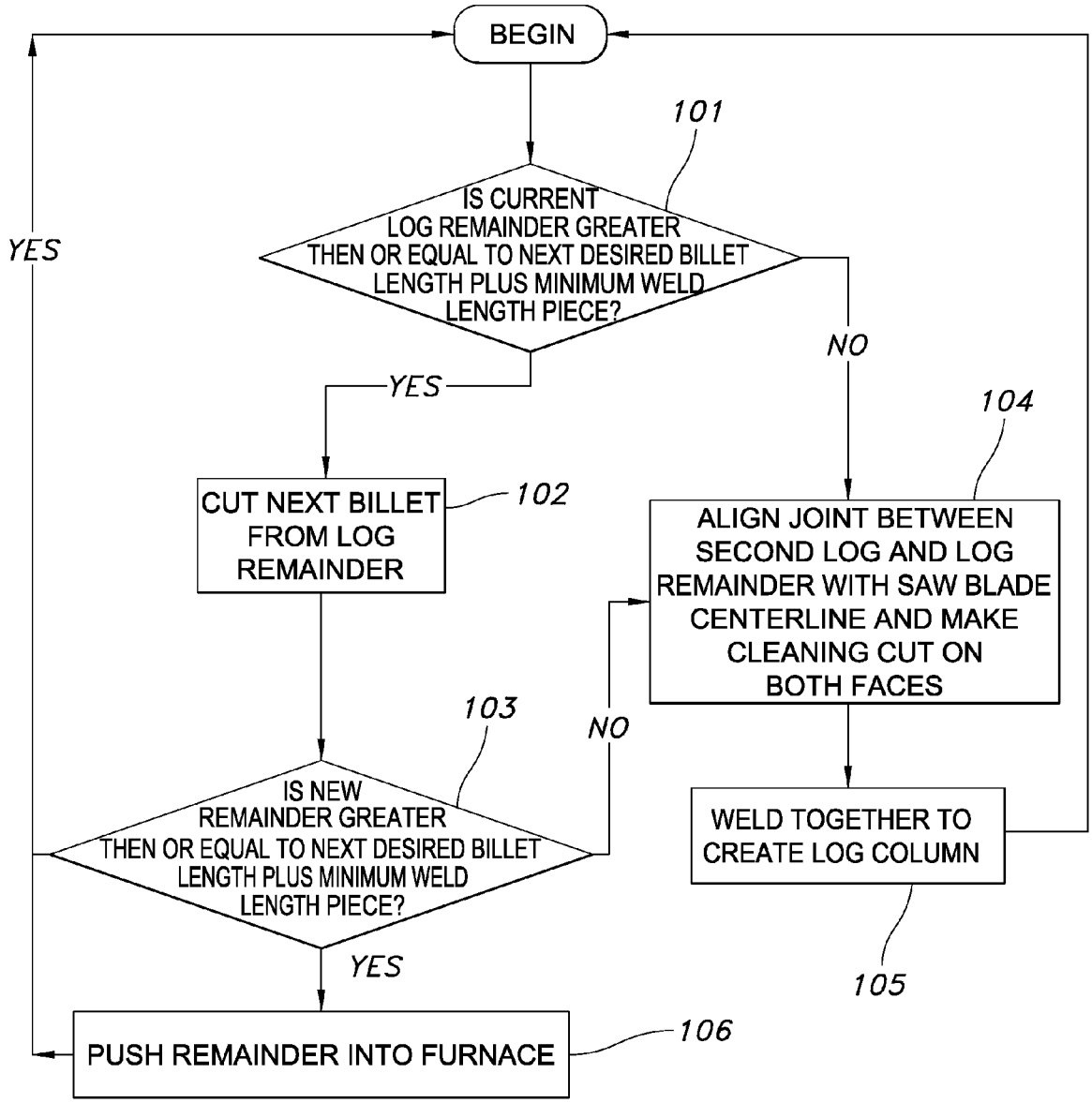
FIG. 7 is a flow chart showing the logic flow of a first method used in creating the continuous log column and in cutting billets from that column.

FIG. 7 is a flow chart illustrating the basic logic control for a first method for processing billets from the log column LC exiting the furnace. A master control system capable of implementing the described methods of the present invention also is generally well known to those skilled in the art. One such system is that sold by Granco Clark, Inc. under the designation Supervisory Control System. Such a system can readily be programmed to implement the method of the present invention.

As illustrated in FIG. 7, logic flow begins when the control system identifies the length of the next billet to be cut from the log exiting the furnace. The first step 101 is to determine whether the length of the current log remainder in the furnace is greater than or equal to (a) the required length of the next billet plus (b) the minimum length of a piece that can be processed by the system for welding to the subsequent log (i.e. the "minimum remainder length"). The minimum remainder length is a function of the physical parameters of the handling assembly 18, and may vary from system to system.

If the answer to step 101 is yes, the log remainder is moved through the door assembly 12 and beyond the saw 14 so that a length of the log corresponding to the length of the desired billet extends beyond the saw. The saw hold-downs are activated to secure the log in a stationary position, and the saw 14 is activated to cut 102 the next billet from the log remainder. The cut billet on the discharge tray 16 is moved onto a transveyor (not shown) for delivery to the press. The next step 103 is to determine whether the new remainder is greater than or equal to the length of the next billet plus the minimum remainder length. If the answer is yes, the log remainder remaining after the cut is pushed 106 back into the furnace through the door assembly 12 using a conventional ram cylinder 22 in the handling assembly 18.

The sequential loop of steps 101, 102, 103, and 106 continues until the length of the new remainder is less than the next billet length plus the minimum remainder length. At that point, control passes to step 104 in which the weld cycle commences. The log column is advanced out of the furnace until the abutting faces of the remainder and the second log are past the saw blade centerline. The discharge tray 16 is retracted from the saw 14; the grippers 30 are lowered to surround the log remainder; and the grippers are closed about the log remainder. The grippers are then raised to lift the remainder so that the remainder does not interfere with insertion of the pushback mechanism 22. While the log remainder is temporarily lifted, the pushback mechanism 22 pushes the succeeding log back toward the furnace until the front face of the succeeding log is aligned with the centerline of the saw blade. The log is secured in position by activating the saw hold-downs, and the pushback mechanism 22 is retracted.

Figure 2:
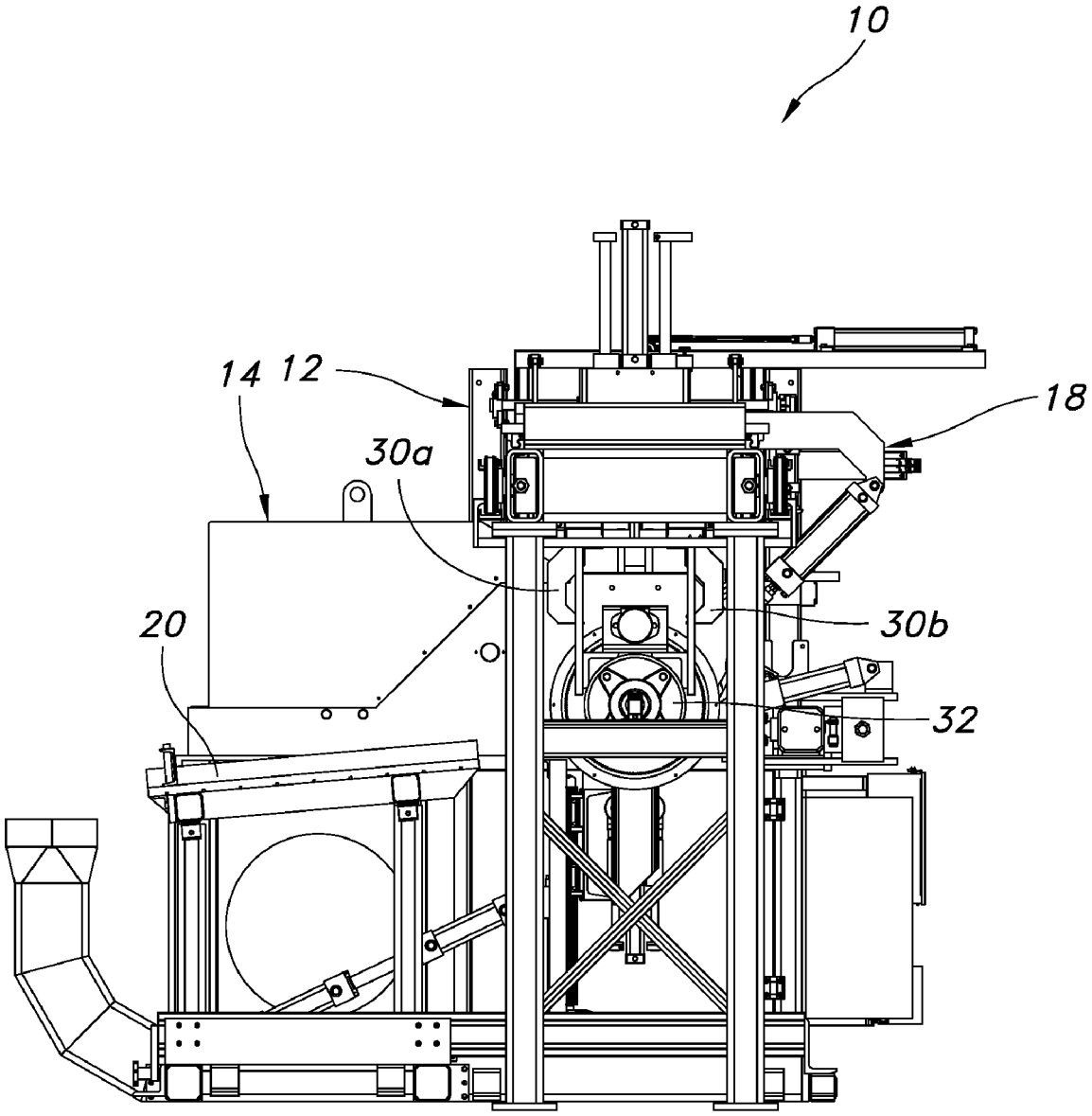
FIG. 2 is a back end elevational view of the system.
Figure 3:
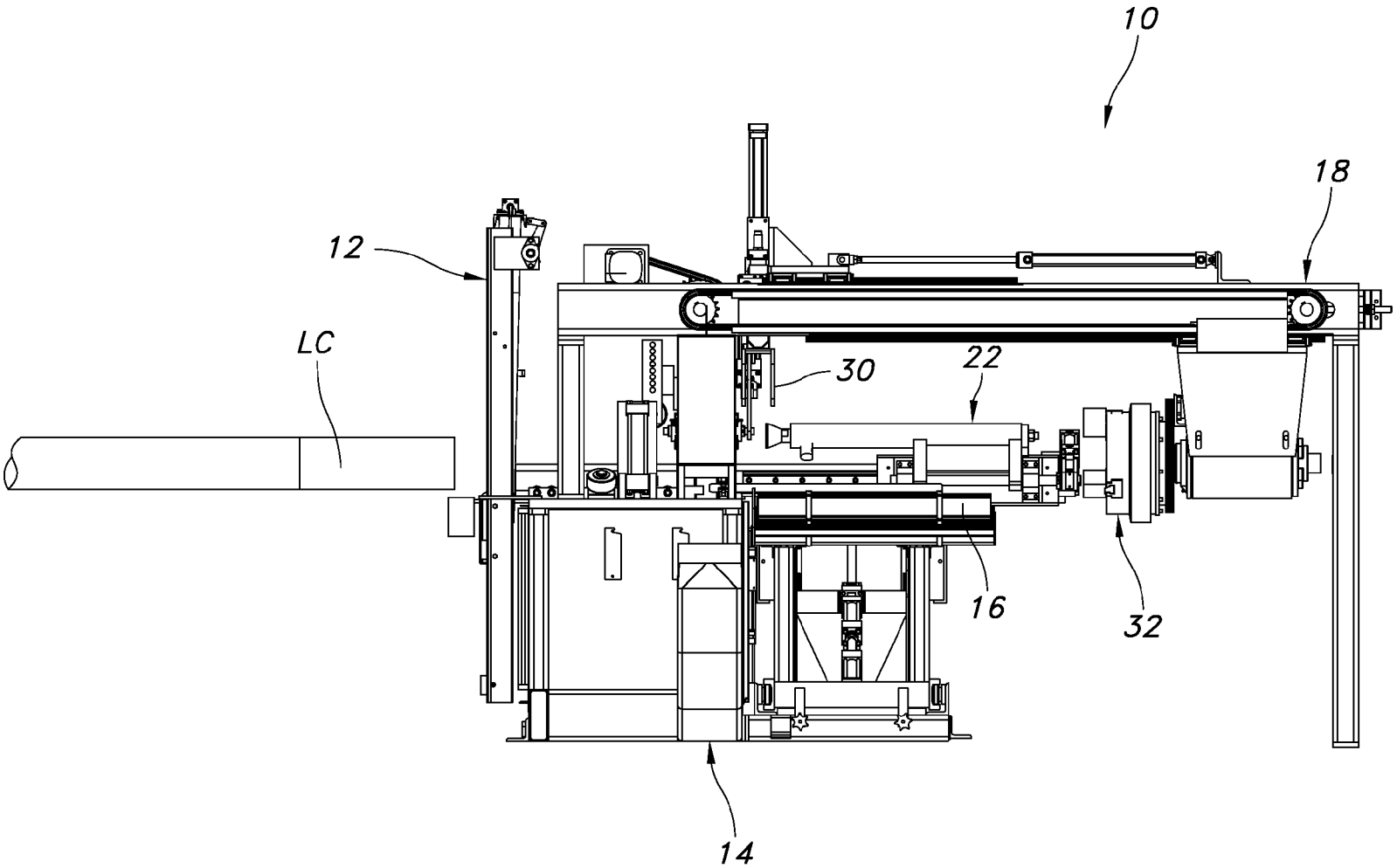
FIG. 3 is a left side elevational view of the system.
Figure 4:
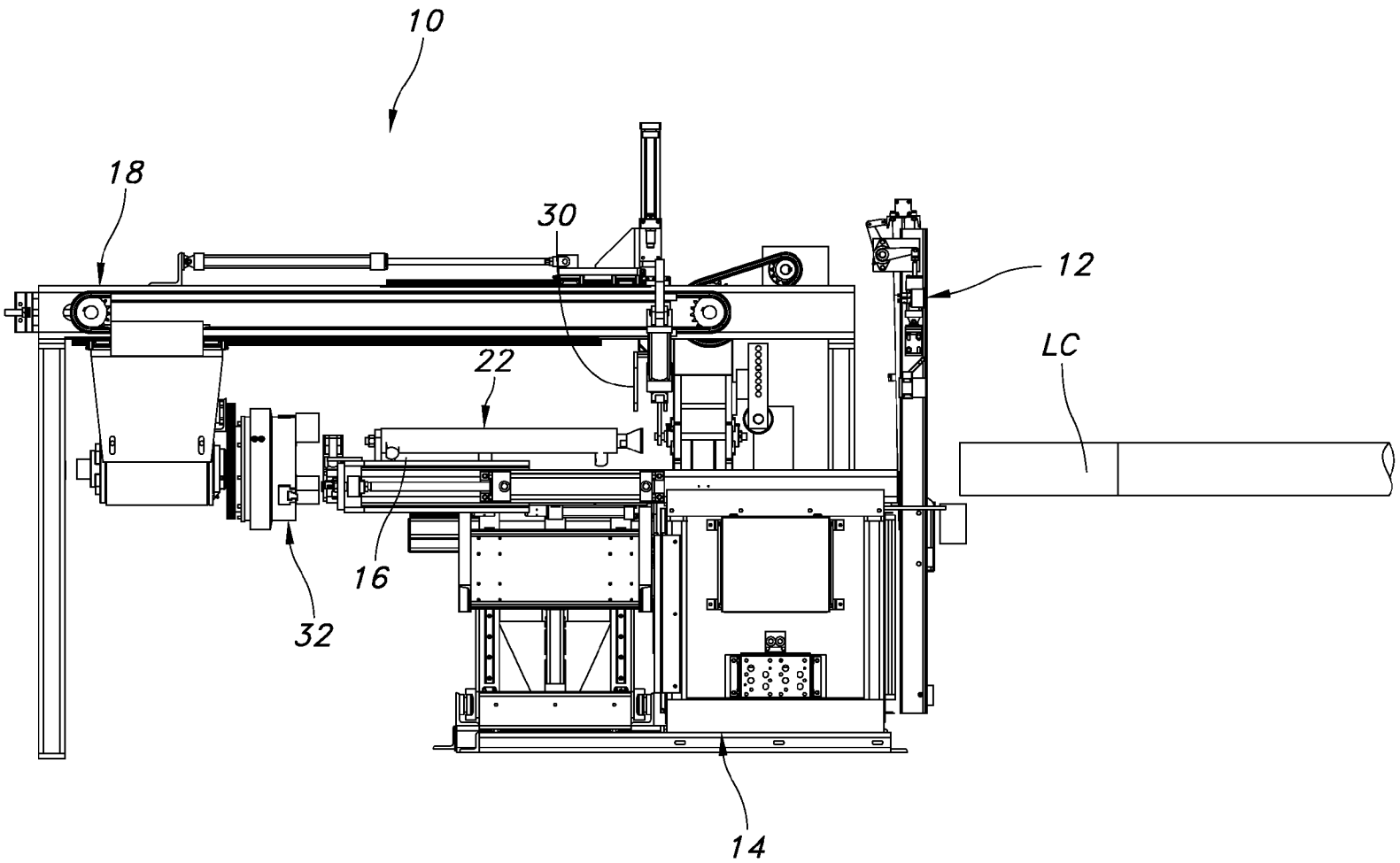
FIG. 4 is a right side elevational view of the system.
Figure 5:
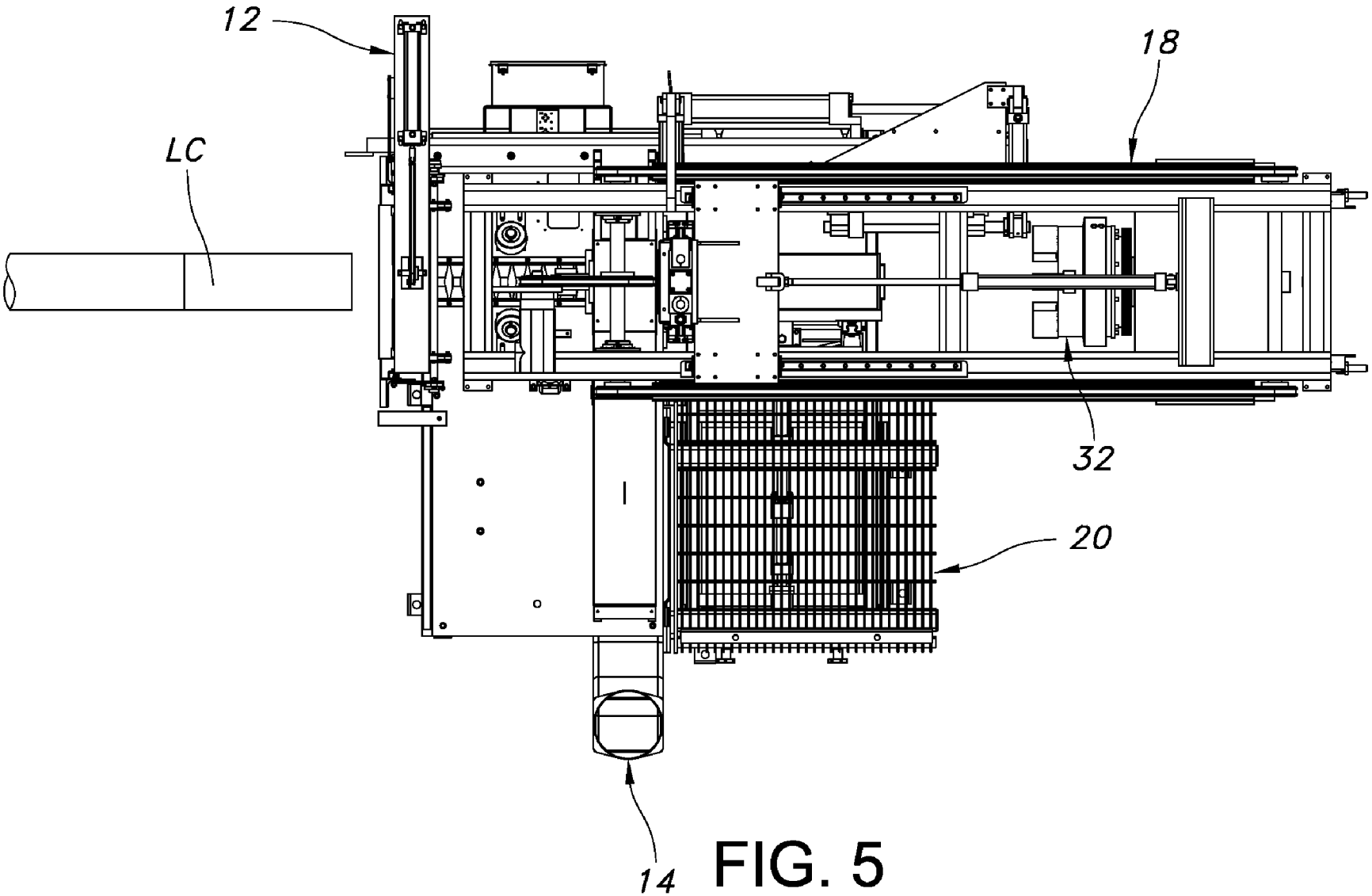
FIG. 5 is a top plan view of the system.
Figure 6:
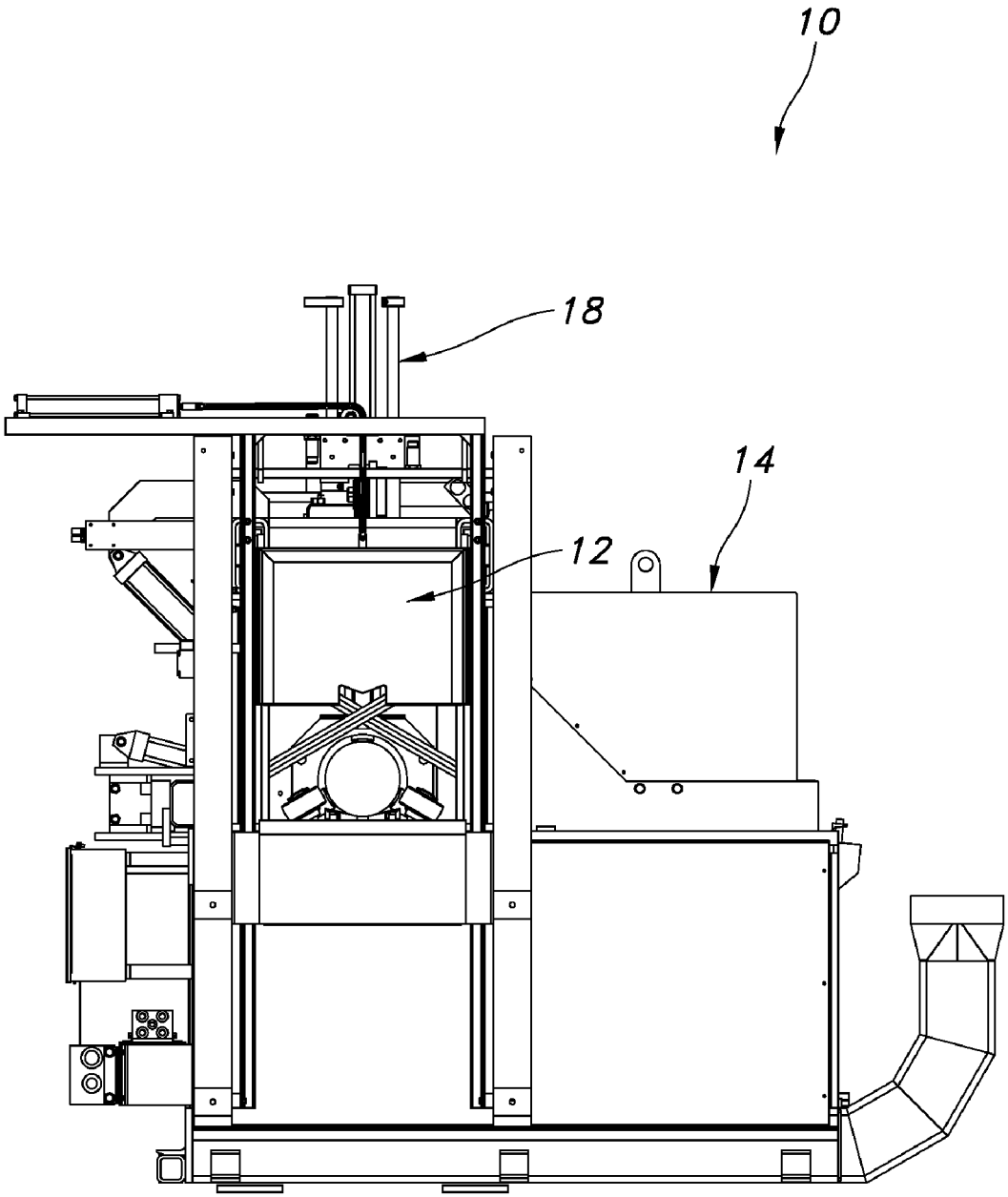
FIG. 6 is a front end elevational view of the system.

After the succeeding log has been positioned, the grippers 30 are lowered until the remainder is axially aligned with the succeeding log. The chuck 32 is opened and moved toward the furnace until the chuck fits over the log remainder. The chuck 32 is then closed about the log remainder. The grippers 30 are opened and returned to the upper position as illustrated in FIG. 2. The chuck 32 and the grippers 30 move the log remainder toward the second log until the two oxidized faces abut one another and are aligned with the centerline of the saw. The remainder is secured with a hold down and the saw blade makes a cut (referred to as a "clean-up cut"). The kerf of the saw blade is sufficiently wide to remove material from both of the abutting faces. Consequently, the clean-up cut removes oxidation from both faces, and simultaneously makes the faces square and true. Other techniques for removing oxides may be used in addition to, or as an alternative to, the cutting operation. One such technique would be wire brushing the ends of the remainder and/or the succeeding log.

The next step 105 is to attach the log remainder to the succeeding log. In the current methods, the attachment is created by friction welding, and more particularly by twist welding. Specifically, the chuck 32 applies axial pressure and rotates the log remainder as required to weld the two cut faces together. For some applications, it is anticipated that a fraction of a relative revolution (e.g. 60 degrees) may be appropriate. For other applications, it is anticipated that multiple relative revolutions may be appropriate. The amount of axial pressure and relative rotation for any application will depend on the metal alloy and the desired results. Other techniques for friction welding may be used in addition to, or as an alternative to, the twist welding. Such techniques include relative linear motion, oscillating motion, and vibrational motion.

An inert gas (e.g. argon or nitrogen) can optionally be directed into the area of the cut, and therefore onto the cut faces, to inhibit the formation of oxides after the "clean-up cut" and before the spin welding.

The axial pressure and the relative rotation create a "twist weld" or a "spin weld" (e.g. a form of friction weld) causing the two sawn faces to fuse to one another. The twist weld eliminates entrapped air at the weld union. Other suitable attachment processes could be used, but are currently believed to be less preferable, most notably because of the opportunity to entrap air. The reattachment of the log remainder to the succeeding log creates a modified log column.

Following block 105, the log column is moved back into the furnace through the door assembly 12—first by the chuck 32 and second by the ram cylinder 22. After the log column is sufficiently reheated, the log column can be moved forward out of the furnace for cutting of the next billet. The welded seam between the log remainder and the succeeding log is essentially air tight, preventing the entrapment of air during subsequent extrusion in the press.

Figures 8, 9, 10, 11, 12, 13, 14:
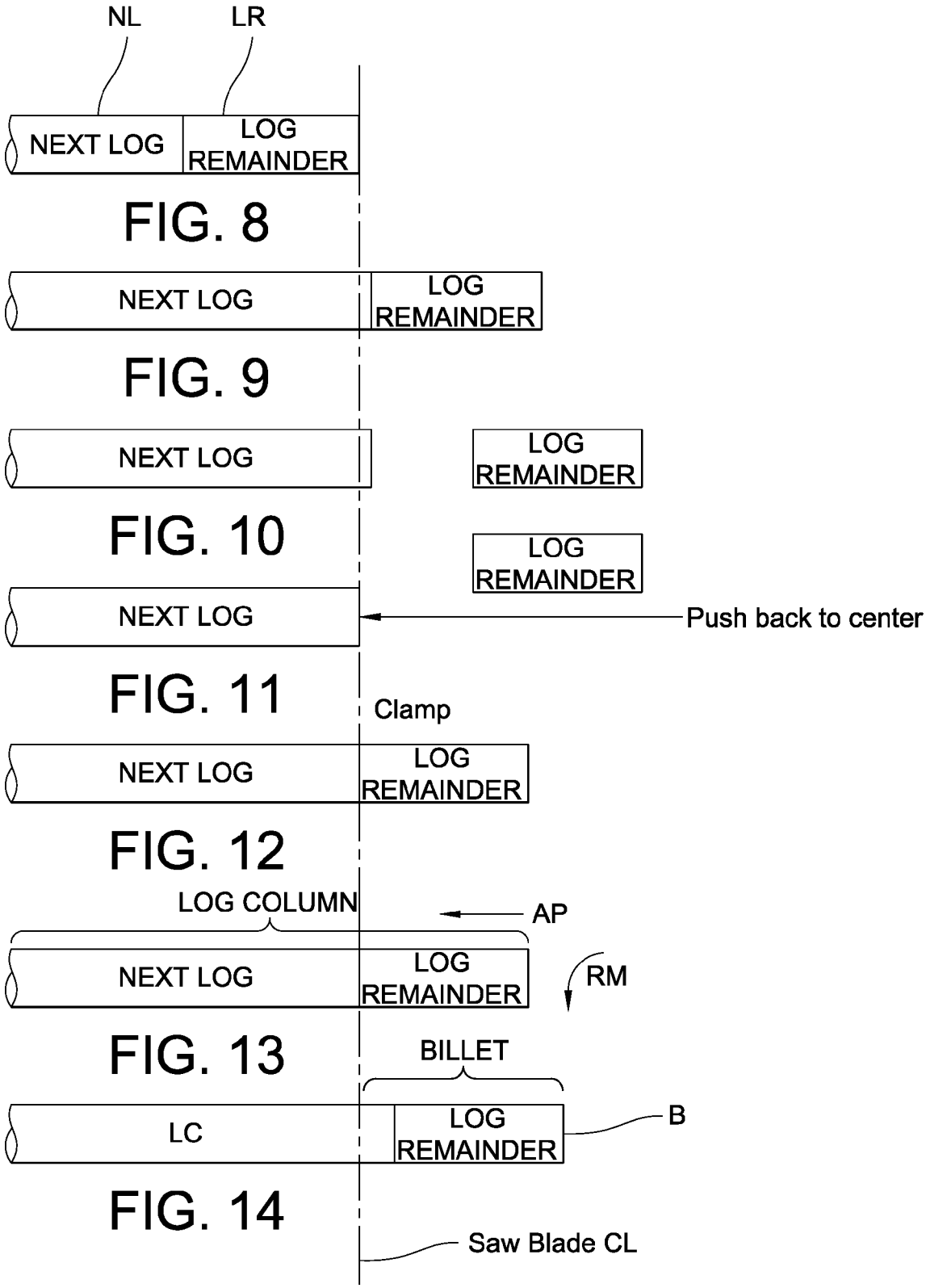
FIGS. 8-14 are schematic illustrations of the hot log column at various steps of the first method.

FIGS. 8-14 schematically illustrate the position of the logs, the billets, and the remainders during the steps of the first method. FIG. 8 illustrates the position of the log remainder LR immediately following cutting of the last billet from the "first" log. At this point, the next log NL is still in the furnace. FIG. 9 illustrates the position of the abutting next log NL and log remainder LR (beyond the saw blade centerline) after the log column has been advanced from the furnace so that the log remainder is accessible to the grippers 30. FIG. 10 shows the log remainder LR retracted by the discharge tray 16. FIG. 11 illustrates the log remainder LR lifted by the grippers 30 and the next log NL aligned with the saw blade centerline by the pushback mechanism 22. FIG. 12 shows the log remainder LR axially aligned with and abutting the next log NL. At this point the "clean-up cut" is made so that clean cut faces are created on both the log remainder LR and the next log NL. FIG. 13 shows the application of axial pressure AP and rotational movement RM to the log remainder LR to twist weld the log remainder to the next log NL. FIG. 14 shows the length of the next billet B being shorter than the welded log remainder LR. As can be seen, the continuously built log column LC provides an effectively endless log of aluminum from which billets may be cut.

Although the first method cuts both faces with a single cut, it is possible that separate cuts may be required or desired for the two faces. For example, it is possible that the two abutting faces have an abutting unevenness that exceeds the width of kerf of the saw blade. In that case, separate cuts may be required for each face.

III. Second Method

Figure 15:
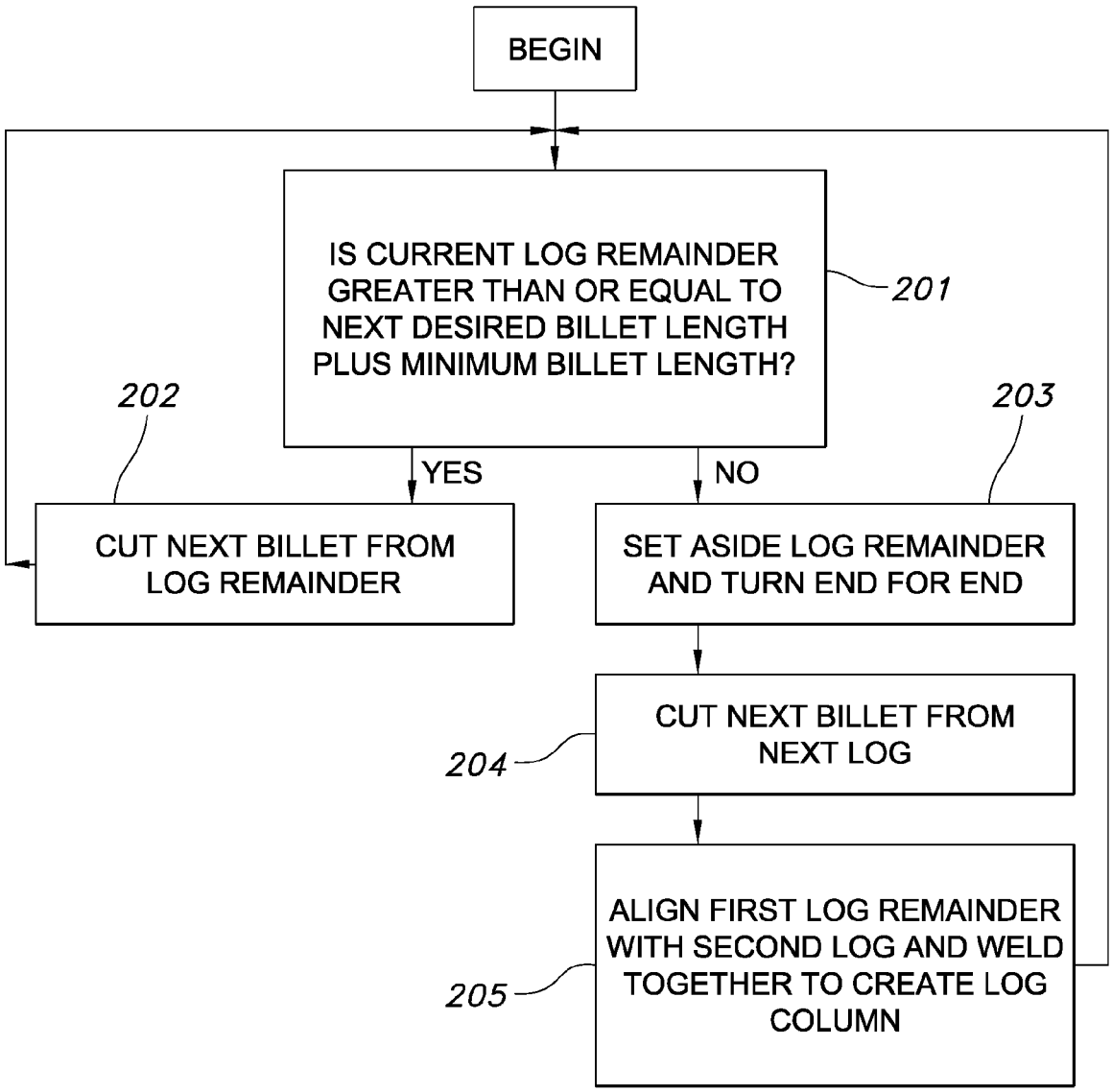
FIG. 15 is a flow chart showing the logic flow of a second method used in creating the continuous log column and in cutting billets from that column.

FIG. 15 is a flow chart illustrating the basic logic control for a second method for processing cutting billets from the log column LC exiting the furnace.

As illustrated in FIG. 15, logic flow begins when the control system identifies the length of the next billet to be cut from the log exiting the furnace. The first step 201 is to determine whether the length of the current log remainder in the furnace is greater than or equal to (a) the required length of the next billet plus (b) the minimum remainder length. If the answer is yes, control passes to block 202. The log remainder is moved through the door assembly 12 and beyond the saw 14 so that a length of the log corresponding to the length of the desired billet extends beyond the saw. The saw hold-downs are activated to secure the log in a stationary position, and the saw 14 is activated to cut the next billet from the log remainder. Although not specifically shown in the flow chart, the log remainder remaining after the cut is pushed back into the furnace through the door assembly 12 using the ram cylinder 22; and the cut billet on the discharge tray 16 is moved onto a transveyor (not shown) for delivery to the press.

The sequential loop of steps 201 and 202 continues until the length of the log remainder is less than (a) the length of the next billet plus (b) the minimum remainder length. At that point, control passes to step 203 in which the log remainder is temporarily moved out of the log/billet path. Specifically, the grippers 30 are lowered to surround the log remainder, and the grippers are closed about the log remainder. The grippers 30 are then raised to lift the log remainder so that the log remainder does not interfere with subsequent logs existing the furnace. The log is held or stored in this holding or temporary storage position. The log remainder is also turned end-for-end 203 so that the most recently cut end of the log faces the furnace door 12.

While the log remainder is temporarily stored and turned, the next or succeeding log is moved out of the furnace so that the next billet can be cut 204 from that log. Specifically, the log is moved from the furnace so that the log extends beyond the saw 14 a distance equal to the desired length of the billet. The log is secured in position, and the saw 14 is activated to cut 204 the billet from the log.

After the first billet has been cut from the succeeding log, logic flows to block 205 including the steps for attaching the log remainder to the succeeding log. The gripper assembly is lowered until the remainder is axially aligned with succeeding log. The chuck 32 is opened and moved toward the furnace until the chuck fits over the log remainder. The chuck 32 is then closed about the log remainder. The grippers 30 are opened and returned to the upper position as illustrated in FIG. 2. The chuck 32 and the grippers 30 move the log remainder toward the second log until the two sawn faces abut one another. The chuck 32 applies axial pressure and rotates the log remainder.

Following block 205, the log column is moved back into the furnace through the door assembly 12—first by the chuck 32 and second by the ram cylinder 22. The next billet typically will be shorter than the reattached log remainder. However, the next billet could also be longer than the reattached log remainder.

Figure 16:
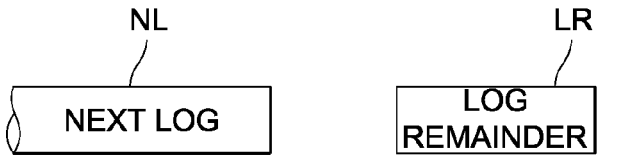
FIGS. 16-22 are schematic illustrations of the hot log column at various steps of the second method.
Figure 17:
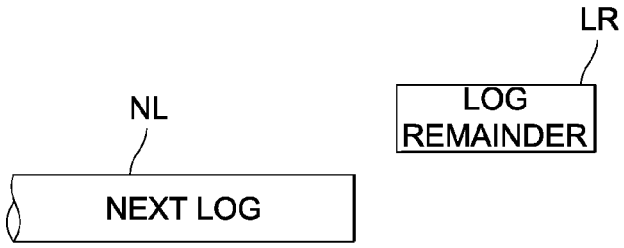
Figure 18:
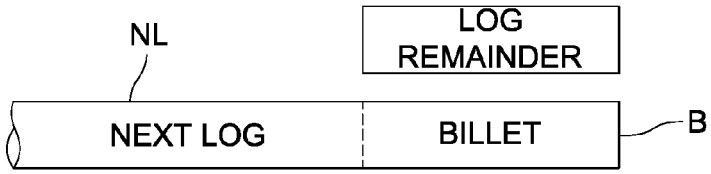
Figure 19:
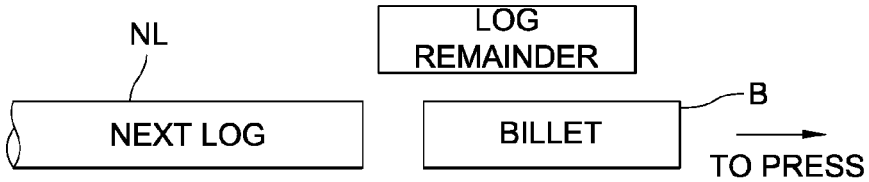
Figure 20:
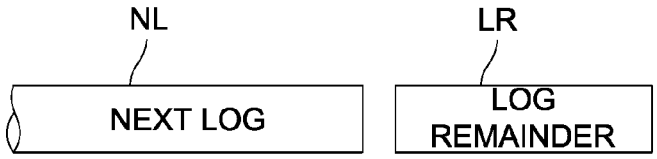
Figure 21:
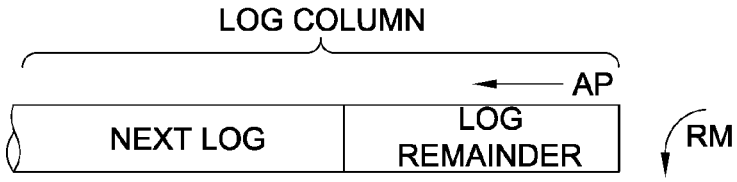
Figure 22:
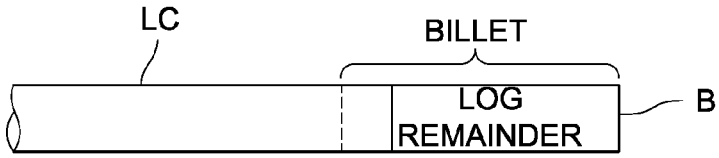

FIGS. 16-22 schematically illustrate the position of the logs, the billets, and the remainders during the steps of the second method. FIG. 16 illustrates the position of the log remainder LR after the last billet has been cut from the "first" log. At this point, the next log NL is still in the furnace 12. FIG. 9 illustrates the log remainder LR after it has been lifted by the grippers 30. At this point, the next log NL is advancing from the furnace. FIG. 10 shows the next log NL extending beyond the saw a distance equal to the length of the next desired billet B. FIG. 11 shows the billet B having been cut from the next log NL and on its way to the press. FIG. 12 shows the log remainder LR turned end-for-end and axially aligned with the next log NL. FIG. 13 shows the application of axial pressure AP and rotational movement RM to the log remainder LR to twist weld the log remainder to the next log. FIG. 14 shows the length of the next billet B being longer than the welded log remainder LR.

IV. Conclusion

Although a saw 14 is disclosed as part of the system 10, the logs may be cut in any suitable fashion known to those skilled in the art. For example, one alternative device for cutting logs is a hot log shear such as that sold by Granco Clark, Inc. However, because a saw produces a clean square face, a saw is currently believed to optimize the twist weld. Further, although cut faces are currently believed to produce the most effective attachment, it also may be possible to effectively attach uncut faces (e.g. the log ends).

The above descriptions are those of current embodiments of the invention. Various alterations and changes can be made without departing from the spirit and broader aspects of the invention as defined in the claims, which are to be interpreted in accordance with the principles of patent law, including the doctrine of equivalents.

The invention claimed is:

1. A method of processing metal logs in a metal extrusion system, the method comprising:

receiving two heated metal logs having abutted ends from a furnace;

aligning the abutted ends of the heated metal logs with a cutting device;

actuating the cutting device to remove metal from both of the abutted ends in a single cutting action to create a cut face on each of the metal logs;

welding the cut faces directly to one another to create a continuous log;

cutting at least one billet from the continuous log; and delivering the at least one billet to a press.

2. A method as defined in claim 1 wherein the cutting device is a saw having a kerf of sufficient width to remove metal from both of the abutted ends during the single cutting action to create the cut faces.

3. A method as defined in claim 1 wherein said welding step comprises friction welding.

4. A method as defined in claim 3 wherein said friction welding step comprises:

creating axial pressure between the two faces; and creating relative rotational motion between the two faces.

5. A method of processing metal logs in a metal extrusion system comprising:

receiving heated metal logs having abutted ends from a furnace;

aligning the abutted ends of two heated metal logs with a saw blade;

actuating the saw blade to remove metal from both of the abutted ends in a single cutting action to create a cut face on each of the metal logs, the saw blade having a kerf of sufficient width to remove metal from both of the heated logs simultaneously during the single cutting action;

friction welding the cut faces directly to one another to create a continuous log;

cutting at least one billet from the continuous log; and delivering the at least one billet to a press.

6. A method as defined in claim 5 wherein the friction welding includes twist welding.

* * * * *